US005511527A

United States Patent [19]

Lorraine et al.

[11] Patent Number: 5,511,527

[45] Date of Patent: Apr. 30, 1996

[54] FUEL RAIL ASSEMBLY WITH CROSSOVER HOSE

[75] Inventors: Jack R. Lorraine, Newport News; Anthony L. Franchitto, Hampton; Gary D. Vattelana, Prince George, all of Va.

[73] Assignee: Siemens Automotive Corporation, Auburn Hills, Mich.

[21] Appl. No.: 496,231

[22] Filed: Jun. 28, 1995

[51] Int. Cl.[6] ..... F02M 55/02

[52] U.S. Cl. ..... 123/456; 123/469; 285/319

[58] Field of Search ..... 123/456, 468, 123/469, 470, 472; 285/319, 921

[56] References Cited

U.S. PATENT DOCUMENTS

| | | | |
|---|---|---|---|
| 4,586,477 | 5/1986 | Field et al. | 123/468 |
| 4,735,440 | 4/1988 | Sauer | 285/319 |
| 5,002,030 | 3/1991 | Mahnke | 123/468 |
| 5,040,729 | 8/1991 | Carrozza | 285/921 |
| 5,056,489 | 10/1991 | Lorraine | 123/456 |
| 5,197,435 | 3/1993 | Mazur et al. | 123/456 |
| 5,251,938 | 10/1993 | Erickson | 285/921 |
| 5,366,254 | 11/1994 | Tucchio et al. | 285/319 |
| 5,390,638 | 2/1995 | Hornby et al. | 123/469 |
| 5,423,577 | 6/1995 | Ketcham | 285/319 |
| 5,445,130 | 8/1995 | Brummer et al. | 123/456 |

*Primary Examiner*—Thomas N. Moulis
*Attorney, Agent, or Firm*—Russel C. Wells

[57] ABSTRACT

A fuel rail crossover hose connection is disclosed for spaced apart fuel rail segments for V engines, the connection including a separate hose barb fitting installed in each end fuel rail segment in lieu of a conventionally configured end cap, and the crossover hose fit to the projecting ends of the fittings.

17 Claims, 2 Drawing Sheets

FUEL RAIL ASSEMBLY WITH CROSSOVER HOSE

BACKGROUND OF THE INVENTION

This invention concerns fuel rail assemblies used in electronic fuel injection systems for automotive vehicles.

Such systems as currently configured utilize a series of electrically operated fuel injectors, each associated with a respective intake valve (or valves) at each engine cylinder. The injectors are opened and closed under the control of signals received from an electronic controller which may be comprised of an engine management computer. This operation causes controlled volumes of fuel to be injected over a timed interval during each engine combustion cycle.

The fuel injectors are supplied with fuel under pressure by means of fuel rails, which are comprised of a hollow pipe supplied with fuel under pressure by a pump connected to the fuel tank.

Fuel rails are typically constructed of formed metal piping or injection molded plastic.

The injectors are mounted in the fuel rails at spaced locations so as to receive a flow of fuel from the associated fuel rail.

For V-6 and V-8 engines, a pair of side-by-side spaced apart fuel rail segments are provided, one segment for each bank of cylinders, the fuel rail segments connected by a crossover tube or hose connected to the rear end of each of the fuel rail segments.

The crossover hose is fitted to hose barbs projecting upwardly and laterally from each fuel rail at a point adjacent the rear ends of the fuel rails, the crossover hose arching across the intake manifold. The ends of each of the fuel rails are plugged, either with a disc brazed into the interior of metal fuel rails, or by a separately installed end cap or plug, used with molded plastic fuel rails.

The crossover hose is located near the firewall, and since it projects upwardly, is vulnerable to separation by sheet metal displaced past the top of engine if the front of the vehicle sustains substantial damage. The integral hose barbs themselves are made thinner than the fuel rail walls to maintain the flow passage cross sectional area, and hence are also vulnerable to damage.

In plastic fuel rails, the hose barbs may be required to extend at a steep upward angle since the barbs must be located on a parting line defined by mounting bracketry also molded as an integral part of the fuel rail. This steep upward angle requires that the crossover hose must be formed with defined bends to roughly conform the hose to the intake manifold contour. This need to form the hose with defined bends increases its manufacturing cost.

Even when formed with these bends, portions of the crossover hose protrude to increase its vulnerability.

The presence of the integral hose barb combined with a separate plug having a seal increases the length of the fuel rails at a point where available firewall clearance is sometimes minimal.

It is therefore the object of the present invention to provide a connection for the crossover hose between two fuel rail segments which renders the connection more compact and the hose less vulnerable to damage while minimizing the cost of the assemblage.

SUMMARY OF THE INVENTION

The above-recited object is achieved by eliminating the integral hose barbs to allow shortening of the fuel rails, and instead forming each of the end caps as a separate hose barb fitting having one end received in the fuel rail end, and the other end formed with a hose barb. The one end of each fitting is held axially in the respective fuel rail end as by heat staking a fitting flange over a flange on the end of the fuel rail. Projections may also be snap fit into recesses to create an axial lock for straight fittings not requiring rotational adjustment. An 0-ring seal is retained on the fitting end held inserted in the fuel rail end to seal the fitting one end to the fuel rail interior wall.

In one embodiment, the hose barb fitting is an elbow, and the connection allows rotation of the fitting to angle the projecting end of the elbow fitting at an optimum upward angle. The rotatability of the fitting combined with a limited tilt of the inserted end of the elbow allowed greatly reduces its susceptibility to breakage. Since the upward angle of the projecting arm of each elbow fitting can be optimized, the hose can be smoothly arched over the intake manifold without bends and in close conformity to the intake manifold contour, minimizing its cost and vulnerability to damage.

In the other embodiment, the fitting is straight and the crossover hose is formed with bends immediately adjacent the projecting end of each straight fitting.

The hose barb fittings are used in lieu of end caps, and are preferably identical for each fuel rail segment, and may advantageously be molded from stronger plastic than the fuel rails themselves to provide further strength.

The hose barb fittings may also be used with metal fuel rails to eliminate the brazed end plugs, which are a disadvantage as the blind passage created by the plug makes cleaning of the interior of the fuel rails after plating processing more difficult and less reliable and thus increases the risk that residual particles may be left in the fuel rail.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
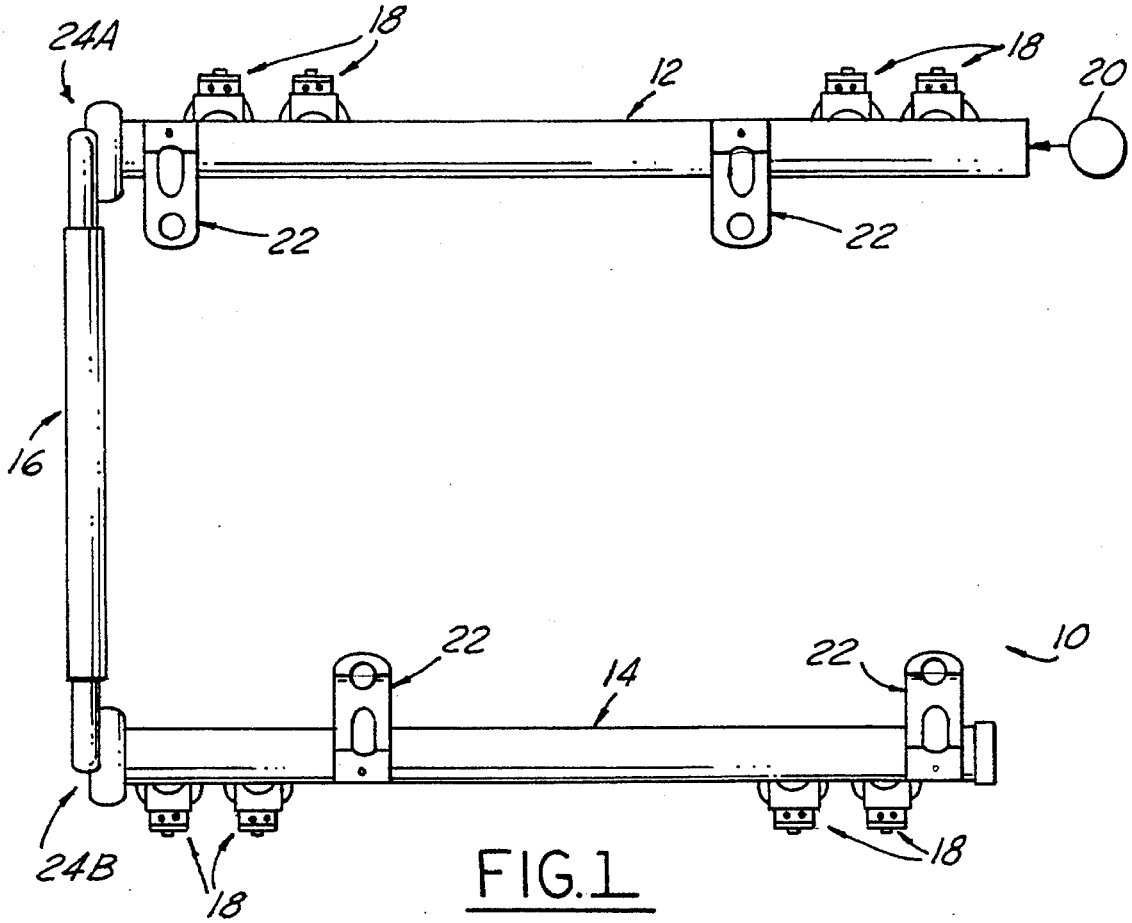
FIG. 1 is a plan view of a fuel rail assembly including segments connected at one end with a crossover hose connection according to the present invention.
Figure 2:
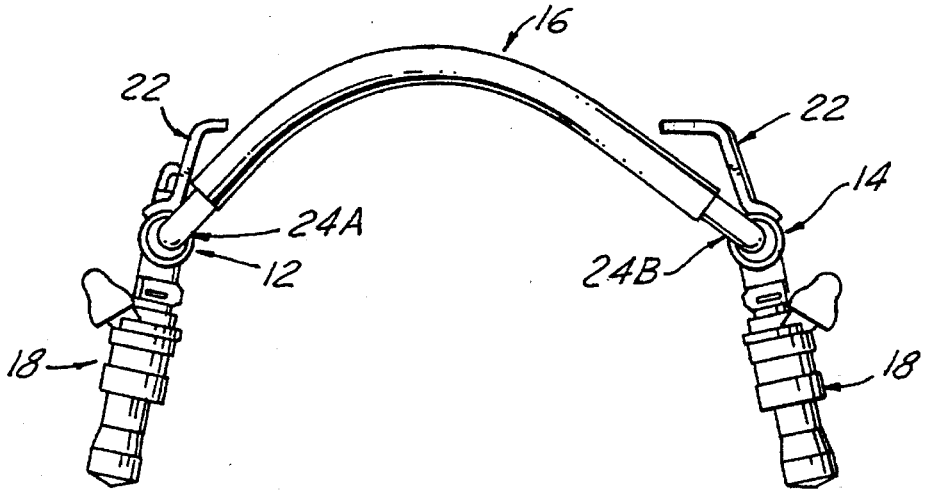
FIG. 2 is an end view of the fuel rail assembly shown in FIG. 1.
Figure 3:
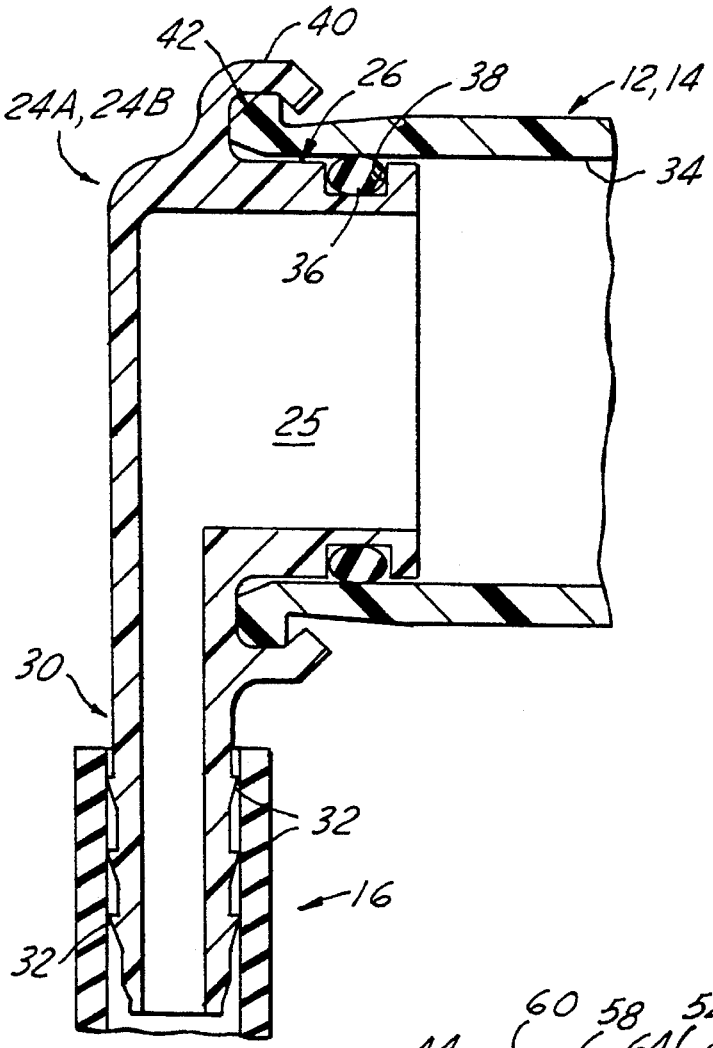
FIG. 3 is an enlarged sectional view of an end cap hose barb fitting according to a first embodiment of the present invention.

Referring to FIGS. 1 and 2, a fuel rail assembly 10 is shown, which is of a type adapted for use with a V type engine, in which a pair of hollow tube fuel rail segments 12, 14 are disposed side by side, but spaced apart from each other and placed in fluid communication with each other by means of a crossover hose 16 connected at either end to one end of each of the fuel rail segments 12, 14.

The fuel rail segments 12, 14 each have a series of fuel injectors 18 of conventional design installed so as to receive pressurized fuel from the respective fuel rail segments 12, 14 in the manner well known in the art.

Such fuel injector installations may be of either the so called "top feed" or "bottom feed" types, a top feed installation shown in FIGS. 1 and 2. A source 20 of pressurized fuel is depicted diagrammatically and may be connected at one end as shown, or at an intermediate point along the length of one of the fuel rail segments 12, 14.

The source 20 may be a pump with a suitable fuel pressure regulator by passing fuel back to the fuel tank, as well known in the art.

The fuel rail assembly 10 typically includes mounting brackets 22 unitarily fixed with respect to the fuel rail segments 12, 14.

The fuel rails 12, 14 may be constructed of molded plastic, in which the brackets 22 are integrally formed, or these items can be constructed of metal and the brackets 22 separately formed but attached as by welding or brazing.

According to the concept of the present invention, the crossover hose 16 is connected by means of separate, preferably identical hose barb fittings 24A, 24B, each having an end inserted within an end of a respective fuel rail segment 12, 14.

In the first embodiment shown, the hose barb fittings 24A, 24B are of an elbow configuration, in which the one end 26 received in the fuel rail end 12, 14 is formed at right angles to its other end 30, and which forms a hose barb adapted to receive one end of the crossover hose 16, with ridges 32 serving to retain and seal the hose 16 thereto. The fittings 24A, 24B define an interior space 25 communicating the interior of the fuel rail bore 34 with the inside of the crossover hose 16.

Each fitting one end 26 is relatively loosely fit into the interior wall 34 of the fuel rail segment 12 or 14 to allow some slight tilting to help prevent buildup of stress when forces are exerted tending to shift the hose 16 or the fittings 24A, 24B.

A compressible O-ring seal 36 is received in a groove 38 of the fitting one end 26 compressed against the bore 34 to establish a reliable sealing of each fitting despite the loose fit.

Each fitting 24A, 24B has a flange 40 formed concentrically to the one end 26, while the fuel rails 12, 14 have a facing flange 42.

The facing flanges 40, 42 are mechanically interlocked as by heat staking flange 40 down over flange 42 as shown. This secures the fittings 24A, 24B positively to resist axial separation while allowing relative rotation.

Thus, the hose barb other end 30 may be angled towards each other at the correct angle, allowing smooth arching of the crossover hose 16 in close conformity to the intake manifold (not shown), as shown in FIG. 2. The fittings 24A, 24B are preferably constructed of molded plastic of a suitable composition to resist fuels, as are the fuel rail segments 12, 14, but being much smaller, the fittings could economically be molded from a stronger plastic material.

Figure 4:
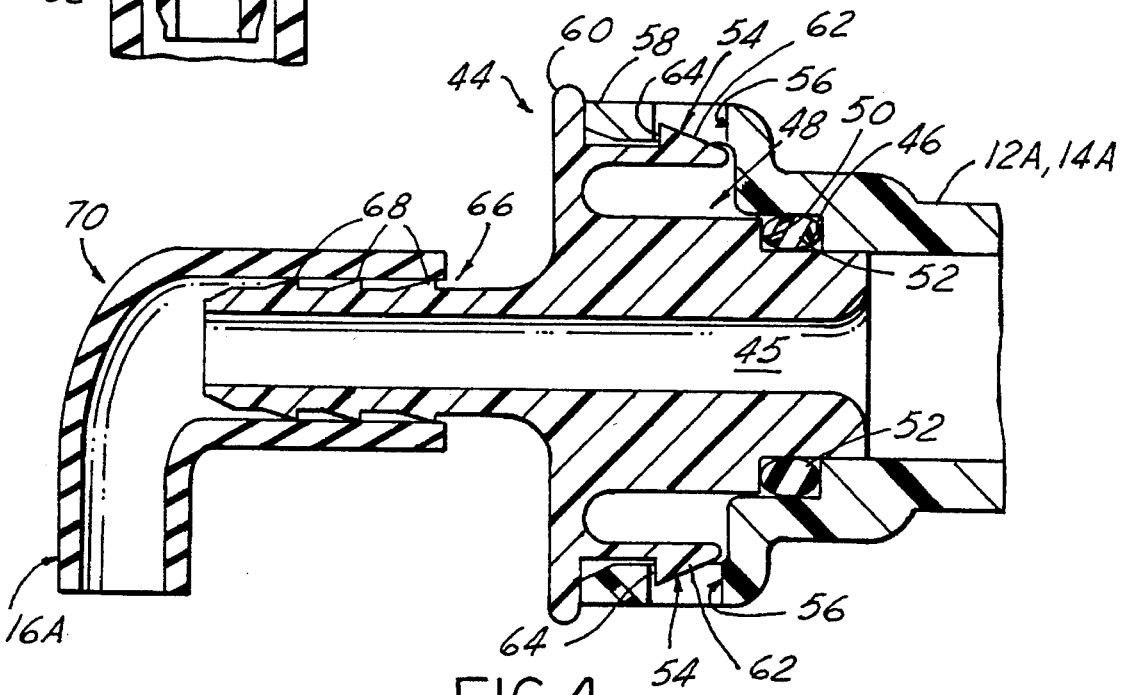
FIG. 4 is an enlarged sectional view of an end cap hose barb fitting according to a second embodiment of the present invention.

FIG. 4 shows a second embodiment of the hose barb fitting 44, which is formed as a straight fitting with each end 40, 66 aligned with each other. In this embodiment, the fuel rail segments 12A, 14A ends are formed with a counterbore 46, while the one end 40 of the fitting 44 received in the fuel rail segment end has a reduced diameter forming a shoulder 50, between which an O-ring seal 52 is compressed.

The one end 48 is held axially by a series of axial projections 54 snap fit into respective circumferentially spaced recesses 56 formed on the outer diameter of a belled end 58 of the fuel rail 12A, 14A.

A radial flange 60 on the fitting 44 abuts the end 58 to limit axial travel into the fuel rail 12A, 12B.

The axial projections have a ramped outer surface 62 to allow camming in at installation, but a squared off back surface 64 locking against the square outer side of the recess 56 to lock and prevent unintended axial movement of the one end 48 out of the fuel rail, maintaining compression of the O-ring seal 52.

In this embodiment, the hose barb end 66 is aligned and extends axially straight away from inserted one end 48, with ridges 68 for sealingly engaging the crossover hose 16A.

An axially extending internal space 45 places the interior of the hose 16A in fluid communication with the fuel rail segment bore 34A.

In this embodiment, the crossover hose 16 is preformed with bends 70 to enable connection between the fuel rail segments 12, 14.

This embodiment has the advantage of allowing shortening of the fuel rail segments, while still properly locating the crossover hose 16A at a desired position.

We claim:

1. A fuel rail assembly for an internal combustion V engine, said fuel rail assembly having a pair of side-by-side spaced apart fuel rail segments, each fuel rail segment including a section of tubing and a plurality of fuel injectors installed therein; a crossover hose connection between said fuel rail segments comprising a pair of end caps each inserted into one end of a respective fuel rail segment, each end cap comprising a hose barb fitting having one end slidably fit into a respective fuel rail end and another arm projecting out of said fuel rail end; a seal on said one end of each hose barb fitting sealing said one end to an interior wall of a respective fuel rail one end; retention means retaining each of said hose barb fittings in position with said one end thereof inserted in said respective fuel rail end; and, a crossover hose having each end fit to a respective fitting projecting end to establish a fluid tight connection between said fuel rail segments.

2. The fuel rail assembly according to claim 1 wherein said fuel rail segments and each of said hose barb fittings are both constructed of molded plastic.

3. The fuel rail assembly according to claim 1 wherein each of said hose barb fittings comprises an elbow fitting, said projecting end of each elbow fitting extending at an angle to said another end received in a respective fuel rail segment end.

4. The fuel rail assembly according to claim 3 wherein said retention means retains said one end of each elbow fitting inserted into an end of a respective fuel rail segment end and comprises means allowing relative rotation therein to enable setting of an upward angle of said projecting end of each elbow fitting and allow a smoothly arching configuration of said crossover hose.

5. The fuel rail assembly according to claim 4 wherein said retention means comprises flanges integrally formed on each of said elbow fitting one ends and on each fuel rail end, said flanges formed to be interfit together to axially retain each of said elbow fitting ends inserted in said respective fuel rail end.

6. The fuel rail assembly according to claim 3 wherein each of said elbow fitting one ends are loosely fit into a respective fuel rail end with said seal interposed, said seal compressible to allow limited tilt of said elbow fitting while maintaining sealing of said connection.

7. The fuel rail assembly according to claim 2 wherein said hose barb fittings are constructed of a stronger plastic than said fuel rail segments.

8. The fuel rail assembly according to claim 1 wherein said one and another ends of each of said hose barb fittings are aligned with each other and extend in opposite directions.

9. The fuel rail assembly according to claim 8 wherein said one end of each hose barb fitting is formed with a shoulder and each of said fuel rail segments ends is formed with a stepped bore forming a shoulder facing said shoulder on a hose barb fitting one end when inserted therein, said seal compressed between said shoulder.

10. The fuel rail assembly according to claim 9 wherein a plurality of axially extending snap locking fingers are formed on one end of said hose barb fitting one end or said fuel rail segment ends and a series of mating recesses are formed in an enclosing mouth portion of the other of said hose barb fittings one end or said fuel rail segment one end, said radially extending snap lock features received in said recesses and interlocked with surfaces of said recesses to provide said retention means when said hose barb fitting one end is inserted into said fuel rail segment end sufficiently to compress said seal between said shoulders.

11. The fuel rail assembly according to claim 10 further including an integral radial flange axially spaced from tips of said snap locking fingers abutting said mouth portion when said snap locking fingers are seated in said recesses.

12. A method of constructing a crossover hose connection for a fuel rail assembly for an internal combustion V engine, said fuel rail assembly comprised of a pair of side-by-side spaced apart fuel rail segments, each formed by an elongated hollow tubular member receiving a series of fuel injectors at spaced locations along the length thereof, said method comprising the steps of:

installing one end of a hose barb fitting in each adjacent end of said fuel rail segments to be sealed and retained there; and, fitting either end of a crossover hose to a respective projecting other end of each of said hose barb fittings to establish fluid communication between said fuel rail segments.

13. The method according to claim 12 wherein each of said hose barb fittings is formed as an elbow, and one end of each elbow fitting is installed so as to be able to be rotated in said respective fuel rail segment end to angle the other end towards the other elbow fitting to allow smooth arching of said crossover hose between said fuel rail segments.

14. The method according to claim 12 wherein said one end of each of said fittings is loosely fitted into a respective fuel rail segment end to allow limited tilting while remaining sealed thereto.

15. The method according to claim 12 wherein said installing step includes the step of assembling an O-ring seal over each one end of said hose barb fittings to seal said ends within a respective fuel rail end.

16. The method according to claim 13 further including the steps of molding each of said elbow fittings and said fuel rail segments from plastic material with respective facing flanges, and heat staking one of each of said facing pairs of flanges over the other to retain each of said elbow fittings in a respective fuel rail segment end, while allowing relative rotation thereof.

17. The method according to claim 12 further including the step of molding said fuel rail segments and said hose barb from different types of plastic.

* * * * *